US006678488B2

(12) United States Patent
Toba et al.

(10) Patent No.: US 6,678,488 B2
(45) Date of Patent: Jan. 13, 2004

(54) IMAGE FORMING APPARATUS TO WHICH A PROCESS CARTRIDGE IS DETACHABLY MOUNTABLE AND PROCESS CARTRIDGE COMPRISING A ROTATION FULCRUM PORTION

(75) Inventors: Shinjiro Toba, Shizuoka (JP); Shigeo Miyabe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 10/015,620

(22) Filed: Dec. 17, 2001

(65) Prior Publication Data

US 2002/0076236 A1 Jun. 20, 2002

(30) Foreign Application Priority Data

Dec. 19, 2000 (JP) ..... 2000-385007

(51) Int. Cl.[7] ..... G03G 21/16
(52) U.S. Cl. ..... 399/111; 399/114
(58) Field of Search ..... 399/107, 110, 399/111, 114, 116, 118, 159; 347/112, 129, 224

(56) References Cited

U.S. PATENT DOCUMENTS

| | | | | |
|---|---|---|---|---|
| 5,331,373 | A | | 7/1994 | Nomura et al. ..... 399/111 |
| 5,452,056 | A | | 9/1995 | Nomura et al. ..... 399/111 |
| 5,463,446 | A | | 10/1995 | Watanabe et al. ..... 399/111 |
| 5,539,447 | A | | 7/1996 | Akuta et al. ..... 347/263 |
| 5,585,889 | A | | 12/1996 | Shishido et al. ..... 399/113 |
| 5,640,650 | A | | 6/1997 | Watanabe et al. ..... 399/117 |
| 5,839,028 | A | | 11/1998 | Nomura et al. ..... 399/109 |
| 5,873,012 | A | | 2/1999 | Miyabe et al. ..... 399/90 |
| 5,878,309 | A | | 3/1999 | Nomura et al. ..... 399/111 |
| 5,878,310 | A | | 3/1999 | Noda et al. ..... 399/117 |
| 5,926,666 | A | | 7/1999 | Miura et al. ..... 399/25 |
| 5,943,529 | A | | 8/1999 | Miyabe et al. ..... 399/111 |
| 5,946,531 | A | | 8/1999 | Miura et al. ..... 399/111 |
| 5,950,047 | A | | 9/1999 | Miyabe et al. ..... 399/111 |
| 5,953,560 | A | * | 9/1999 | Numagami et al. ..... 399/111 |
| 5,966,567 | A | | 10/1999 | Matsuzaki et al. ..... 399/111 |
| 6,029,031 | A | | 2/2000 | Yokomori et al. ..... 399/109 |
| 6,604,843 | B2 | | 5/2000 | Isobe et al. ..... 399/111 |
| 6,072,968 | A | | 6/2000 | Nomura et al. ..... 399/113 |
| 6,154,623 | A | | 11/2000 | Suzuki et al. ..... 399/111 |
| 6,167,219 | A | | 12/2000 | Miyamoto et al. ..... 399/90 |
| 6,173,140 | B1 | | 1/2001 | Suzuki et al. ..... 399/113 |
| 6,215,969 | B1 | | 4/2001 | Nomura et al. ..... 399/111 |
| 6,282,390 | B1 | | 8/2001 | Miyabe et al. ..... 399/111 |
| 6,317,572 | B1 | | 11/2001 | Miyabe et al. ..... 399/111 |
| 6,336,017 | B1 | | 1/2002 | Miyamoto et al. ..... 399/116 |
| 6,351,620 | B1 | | 2/2002 | Miyabe et al. ..... 399/111 |

FOREIGN PATENT DOCUMENTS

| | | |
|---|---|---|
| JP | 6-106772 | 4/1994 |
| JP | 6-202393 | 7/1994 |

* cited by examiner

*Primary Examiner*—Hoan Tran
(74) *Attorney, Agent, or Firm*—Fitzpatrick, Cella, Harper & Scinto

(57) ABSTRACT

A process cartridge, which is detachably mountable to an image forming apparatus main body, includes: an electrophotographic photosensitive drum; a process member acting on the electrophotographic photosensitive drum; a rotation fulcrum portion which constitutes a supported portion of the process cartridge, the supported portion being supported by the image forming apparatus main body when attached to the image forming apparatus main body and which is parallel to the electrophotographic photosensitive drum; and an abutting portion which is spaced apart from the rotation fulcrum portion and which moves when the process cartridge is rotated around the rotation fulcrum portion when the process cartridge is mounted to the image forming apparatus main body to thereby enable a laser beam shielding mechanism provided in the image forming apparatus main body.

17 Claims, 12 Drawing Sheets

IMAGE FORMING APPARATUS TO WHICH A PROCESS CARTRIDGE IS DETACHABLY MOUNTABLE AND PROCESS CARTRIDGE COMPRISING A ROTATION FULCRUM PORTION

BACKGROUND OF THE INVENTION

1. Field of the Invention

The present invention relates a process cartridge and an electrophotographic image forming apparatus.

An electrophotographic image forming apparatus forms an image on a recording medium by using the electrophotographic image forming process. Examples of an electrophotographic image forming apparatus include an electrophotographic copying machine, an electrophotographic printer (e.g., a laser beam printer and an LED printer), a facsimile apparatus, and a word processor.

A process cartridge may be a cartridge into which charging means, developing means, or cleaning means and an electrophotographic photosensitive member are integrally incorporated, and which is detachably mountable to the main body of an electrophotographic image forming apparatus. Alternatively, the process cartridge may be a cartridge into which at least one of the charging means, the developing means, and the cleaning means and the electrophotographic photosensitive member are incorporated, and which is detachably mountable to the main body of the electrophotographic image forming apparatus. Further alternatively, the process cartridge may be a cartridge into which at least the developing means and the electrophotographic photosensitive member are incorporated, and which is detachably mountable to the main body of the electrophotographic image forming apparatus.

2. Description of Related Art

When an electrophotographic image forming apparatus has been used for a long period of time, it is necessary to perform replacement of the photosensitive drum, replenishment or replacement of the developer, and adjustment, cleaning, and replacement of other components (such as the charger and cleaner container).

In view of this, an image forming apparatus using the electrophotographic image forming process adopts a process cartridge system in which an electrophotographic photosensitive member and process means acting on the electrophotographic photosensitive member are integrated into a cartridge, which is detachably mountable to the main body of the image forming apparatus. In the process cartridge system, the user can perform maintenance on the apparatus in person without depending on a serviceman, whereby a substantial improvement can be achieved in terms of operability. Thus, the process cartridge system is widely used for image forming apparatuses.

As shown in FIG. 15, in a conventional process cartridge 45, a development frame 43 supporting developing means, such as a developing roller 18, and a toner container 46 are joined together by ultrasonic welding to form a development unit. Then, a cleaning unit formed by mounting a photosensitive drum 11 and a charging roller 12 to a cleaning frame 47 is joined to the development unit by a pivot 49. Then, a compression spring (not shown) is provided between the cleaning frame 47 and the development frame 43, biasing the photosensitive drum 11 and the developing roller 18 toward each other.

Such a process cartridge is detachably mountable to the main body of an image forming apparatus. In a cartridge detachably mountable system in which the cartridge is mounted to and detached from the front surface of the main body of an image forming apparatus, the danger of the laser beam leaking to the exterior may be conceived if the cartridge is simply inserted. In view of this, there has been proposed a double laser beam shielding mechanism (Japanese Patent Application Laid-open No. 6-106772 and Japanese Patent Application Laid-open No. 6-202393. However, use of a conventional laser beam shielding mechanism operationally connected with the attachment and detachment of the cartridge may result in a rather complicated mechanism.

SUMMARY OF THE INVENTION

It is an object of the present invention to provide an electrophotographic image forming apparatus in which a laser beam does not leak to the exterior of the apparatus main body and a process cartridge detachably mountable to the apparatus main body.

Another object of the present invention is to provide an electrophotographic image forming apparatus in which a process cartridge is mounted to the apparatus main body and in which, when an opening/closing member that can be opened and closed with respect to the apparatus main body is closed, an optical path for a laser beam is opened to allow passage of the laser beam, and a process cartridge detachably mountable to the apparatus main body.

Still another object of the present invention is to provide a process cartridge which has an abutting portion which, when the process cartridge is mounted to the main body of an image forming apparatus by dropping the process cartridge in the main body, abuts a means for moving a shielding member shielding an optical path for a laser beam from a shielding position to a retracted position, and an electrophotographic image forming apparatus to which the process cartridge is detachably mountable.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

An embodiment of the present invention will be described with reference to FIGS. 1 through 8. In this embodiment, the term "longitudinal direction" refers to a direction perpendicular to the direction in which the recording medium is conveyed and parallel to the plane of the recording medium.

Description of the Process Cartridge and the Apparatus Main Body

Figure 1:
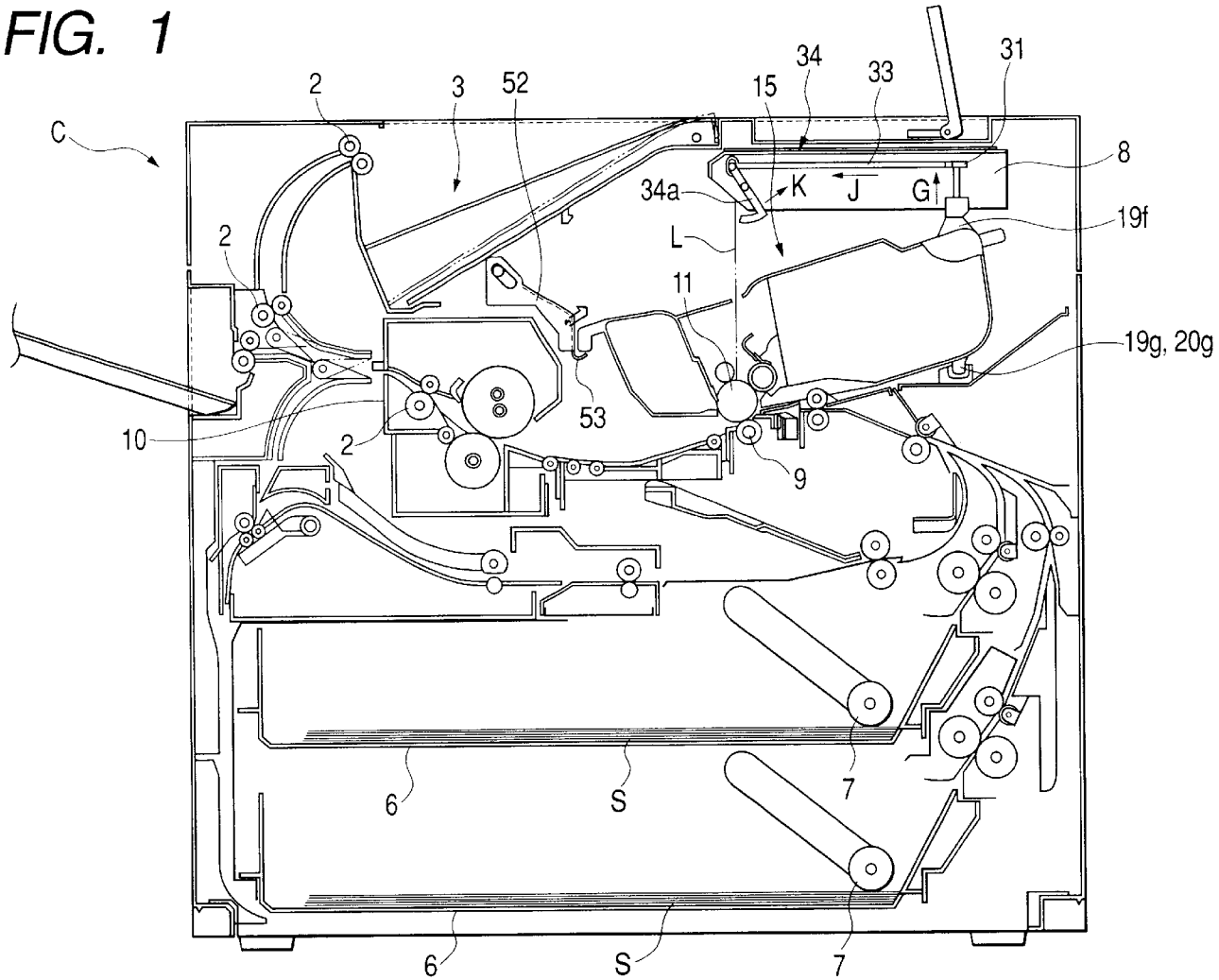
FIG. 1 is a vertical sectional view of an image forming apparatus.
Figure 2:
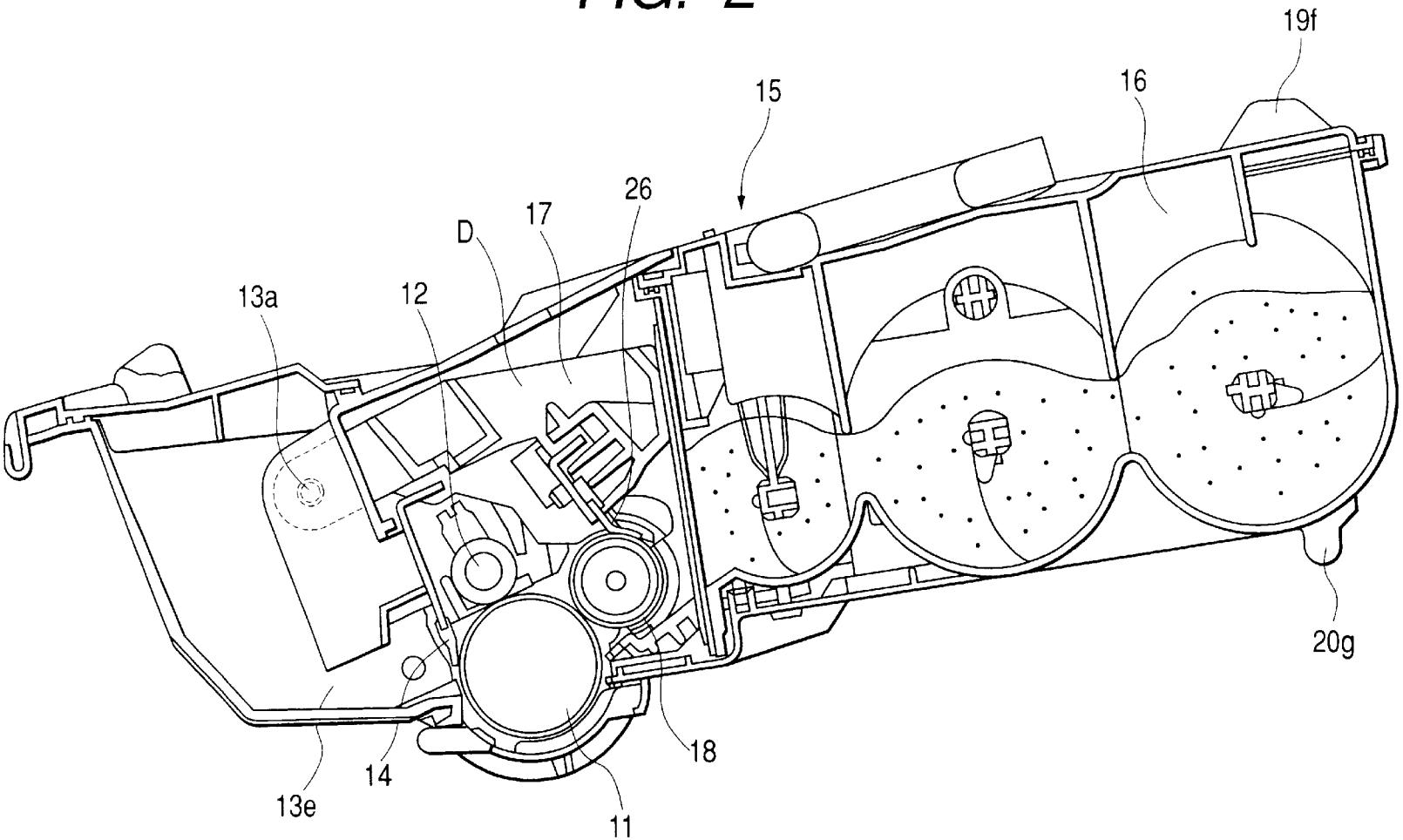
FIG. 2 is a schematic principal sectional view of a process cartridge in accordance with an embodiment of the present invention.

FIG. 1 is a principal sectional view of an image forming apparatus according to the present invention, and FIG. 2 is a principal sectional view of a process cartridge according to the present invention. The process cartridge is equipped with an electrophotographic photosensitive member and process means acting on the electrophotographic photosensitive member. The process means includes, for example, charging means for charging the surface of the electrophotographic photosensitive member, developing device for forming a toner image on the electrophotographic photosensitive member, and cleaning means for removing toner remaining on the surface of the electrophotographic photosensitive member.

As shown in FIG. 2, in a process cartridge of this embodiment, there are arranged around an electrophotographic photosensitive drum 11 charging means consisting of a charging roller 12, a developing device consisting of a developing roller 18 and a development blade 26, and cleaning means consisting of a cleaning blade 14. These components are covered with a housing to integrally constitute the process cartridge 15, which is detachably mountable to the image forming apparatus main body (hereinafter referred to as the apparatus main body) C.

The cartridge 15 is attached to an electrophotographic image forming apparatus as shown in FIG. 1 for image formation. When performing image formation, sheets S are conveyed by conveying roller 7 from sheet cassettes 6 mounted in the lower portion of the apparatus. In synchronism with the sheet conveyance, an exposure device 8 performs selective exposure on the photosensitive drum 11 to form a latent image. Thereafter, frictional electrification charge is imparted by the developing blade 26 to toner serving as the developer contained in a toner container 16, and a thin layer of toner is borne on the surface of the developing roller 18. Then, by applying a development bias to the developing roller 18, toner is supplied in accordance with the latent image.

The toner image is transferred to the sheet S serving as the conveying recording-medium by application of bias voltage to the transfer roller 9. Then, the sheet S is conveyed to a fixing device 10 by which the image is fixed. Thereafter, the sheet is discharged to a discharge portion 3 in the upper portion of the apparatus by discharge rollers 2.

On the other hand, the toner remaining on the photosensitive drum 11 after the transfer has been completed is removed by a cleaning blade 14 and stored in a removed toner reservoir 13*e*.

Process Cartridge Frame Construction

The peripheral construction of the developing device will be further described in detail.

Figure 3:
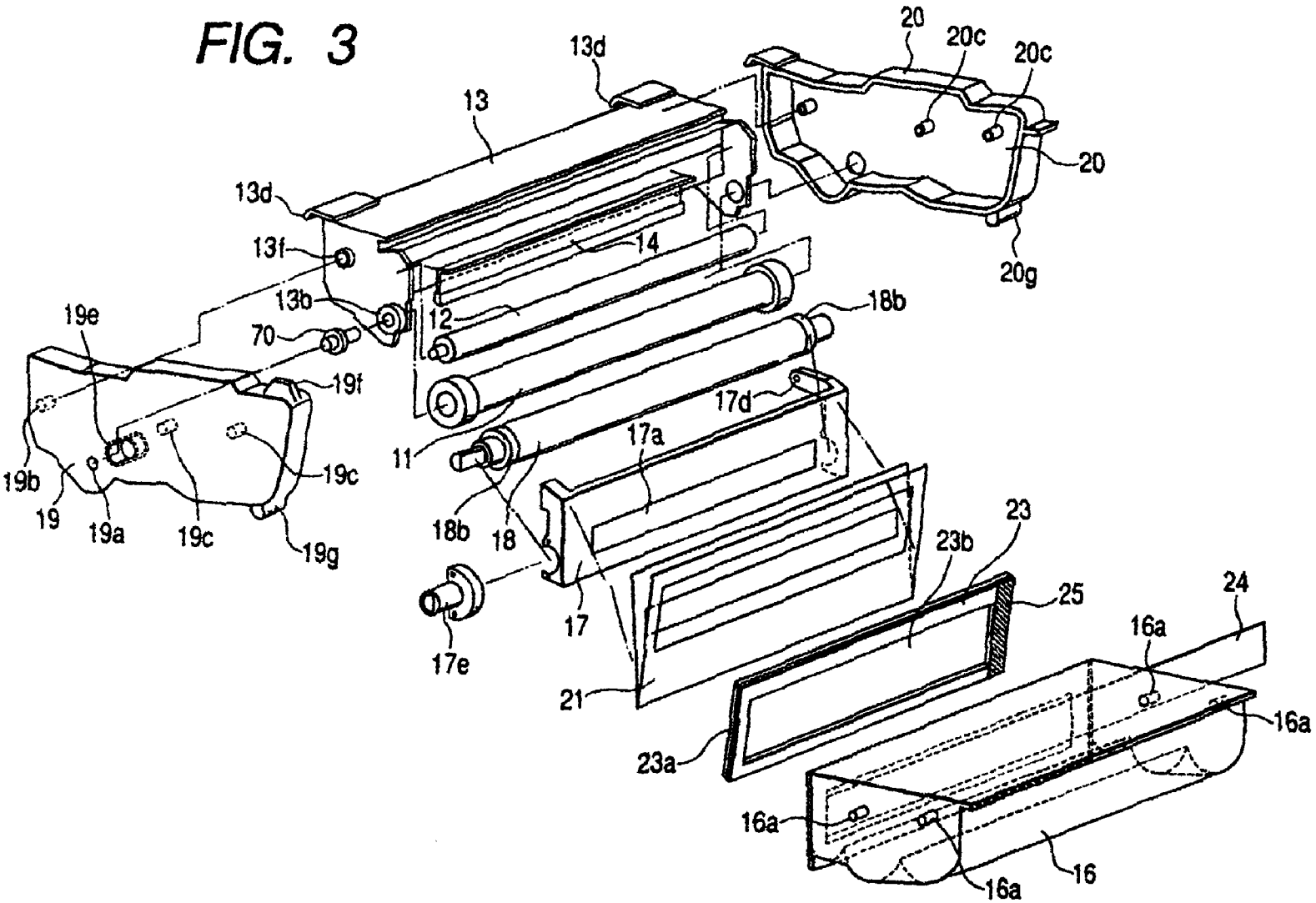
FIG. 3 is an exploded perspective view of a process cartridge in accordance with an embodiment of the present invention.

FIGS. 2 and 3 schematically show the construction of the cartridge 15 of the embodiment. In the developing device D of the cartridge 15, toner stored in the toner container 16 is borne on the surface of the developing roller 18. Then, by applying development bias to the developing roller 18, toner is supplied in accordance with the latent image formed on the photosensitive drum 11.

The developing roller 18 is formed of a cylinder made of metal, such as aluminum and stainless, and includes a magnet roller in the inside of the cylinder.

FIG. 3 is a schematic exploded view showing the cartridge construction. As shown in FIG. 3, the positioning of the toner container 16 is effected by fitting positioning pins 16*a* into bosses 19*c* of a side cover 19 and bosses 20*c* of a side cover 20 before securing the toner container 16 to the side cover 19. Like the toner container 16, a cleaning frame 13 is secured to the side cover 19 by fitting a positioning member 70 supporting the photosensitive drum 11 into a hole 13*b* of the cleaning frame 13 and into a hole 19*a* of the side cover 19 and by fitting a positioning pin 19*b* into a positioning boss 13*f*. Thus, the cleaning frame 13 and the toner container 16 are integrally fixed. Like the side cover 19, a side cover 20 is fixed to the toner container 16 and the cleaning frame 13. That is, the side covers 19 and 20 are support members respectively fixed to the toner container 16 and the cleaning frame 13 in order to integrally support the toner container 16 and the cleaning frame 13, which is a drum frame for supporting the photosensitive drum 11.

Figure 4:
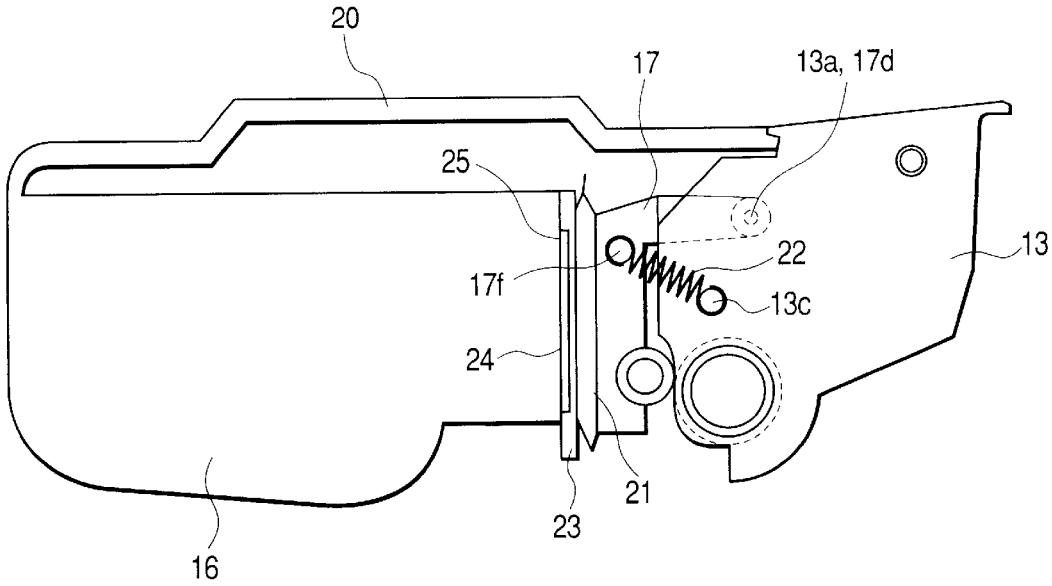
FIG. 4 is a rear view of a process cartridge in accordance with an embodiment of the present invention.

Further, as shown in FIG. 2, a development frame 17 of the developing device D, which supports the developing means, such as the developing roller 18 and the development blade 26, is supported by fitting a pin into a hanging hole 13*a* of the cleaning frame 13 and into a hanging hole 17*d* of the development frame 17 so that the development frame 17 may swing around the hanging hole 13*a*. Then, as shown in FIG. 4, a tension coil spring 22 is stretched between a spring peg 13*c* projectingly provided on the cleaning frame 13 and a spring peg 17*f* projectingly provided on the development frame 17.

Figure 5:
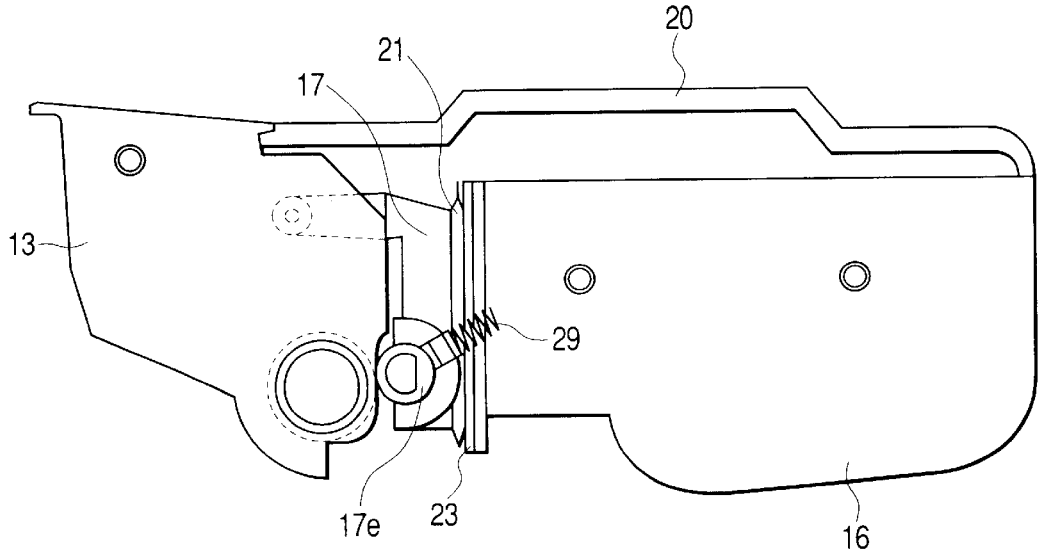
FIG. 5 is a front view of a process cartridge in accordance with an embodiment of the present invention.

Further, as shown in FIG. 5, a compression coil spring 29 is arranged inside the side cover 19 so as to pressurize a developing roller bearing 17*e*. The developing roller bearing 17*e* is guided by a groove 19*e* (see FIG. 3) provided in the side cover 19 so as to extend in the direction of the line connecting the center of the photosensitive drum 11 and the center of the developing roller 18. By the resilient forces of the compression coil spring 29 and the tension coil spring 22, abutment runners 18*b* provided on the opposed ends of the developing roller 18, concentric with the developing roller 18, and having a radius larger by a development gap (approximately 300 $\mu$m) than that of the developing roller 18 are held in pressure contact with the portions of the photosensitive drum 11 outside the image region.

Due to the abutment runners 18*b*, there is a gap between the developing roller 18 and the photosensitive drum 11. Further, the bottom portion of the toner container 16 substantially extends along a horizontal line.

In this embodiment, a structure is employed in which sealing is effected on the gap between the developing device D and the toner container 16, a sheet member as a sealing member being plied up into a bellows-like configuration for hermetic sealing, and mounted through the intermediation of a plate-like member. In this case, the thickness of the sheet member is not more than 1 mm. However, a thickness of not less than 1 mm is also acceptable as long as a material is selected which does not impair the flexibility of the bellows-like configuration.

Next, a method of forming a sheet member into a sack-like sealing member will be schematically described with reference to FIG. 6.

Figure 6:
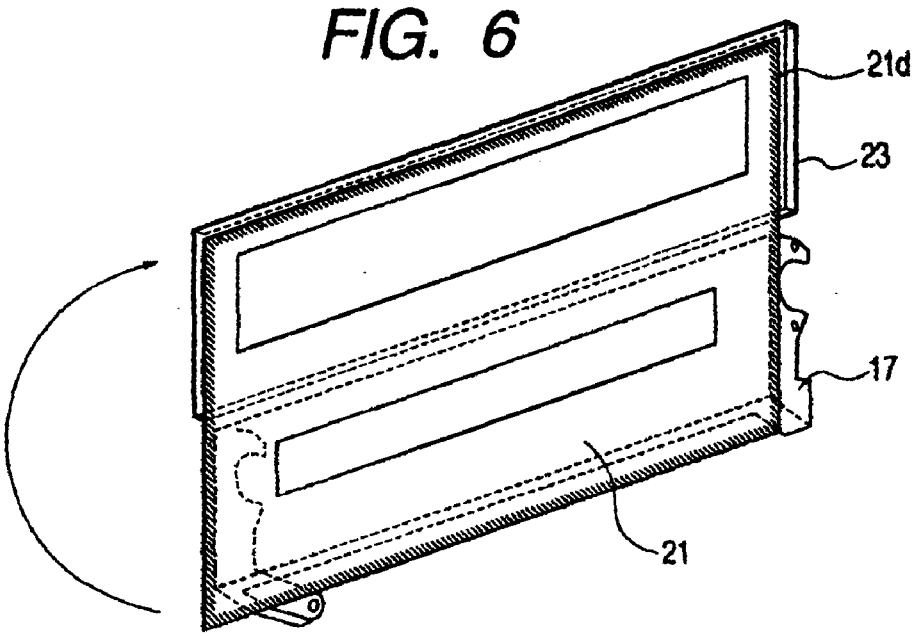
FIG. 6 is a perspective view illustrating a sealing member in accordance with an embodiment of the present invention.
Figure 7:
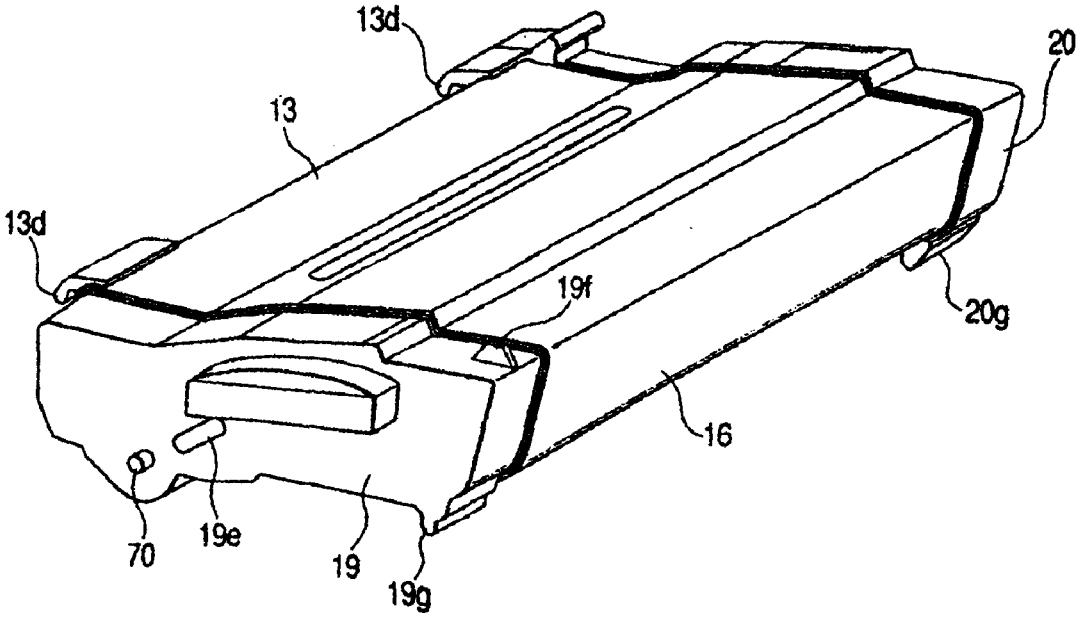
FIG. 7 is an outward perspective view of a process cartridge in accordance with an embodiment of the present invention.

As shown in FIG. 6, a sheet member 21 has openings having areas substantially the same as or larger than those of openings 23*b* and 17*a* of the plate-like member 23 and the development frame 17, respectively.

The end portion 21*d* (hatched portion) of the sheet member 21 is joined to the portions near the openings 23*b* and 17*a* of the plate-like member 23 and the development frame 17, respectively, in a closed form.

In this embodiment, the sheet member 21 is connected to the development frame 17 and the plate-like member 23 by thermal welding, such as heat sealing or impulse sealing. It is also possible to adopt ultrasonic welding, adhesive, adhesive tape, etc.

Next, as shown in FIG. 6, after being attached to the development frame 17 and the plate-like member 23, the sheet member 21 is bent in the direction of the arrow so that the opening surfaces may be opposed to each other to form a bellows (sack-like configuration), the end portions 21*d* (hatched portions) that are superimposed one upon the other when folded being joined to each other for hermetic sealing. In this case also, the sealing may be effected by thermal welding, such as heat sealing and impulse sealing, or ultrasonic welding, adhesive, or adhesive tape.

Next, the plate-like member 23 is mounted to the toner container. At this time, part of the mounting is not effected through welding or adhesion so as to allow passage of the toner seal 24.

As shown in FIG. 3, in this embodiment, a portion 23*a* is welded, and no welding or adhesion is effected in the region where a toner sealing member 25 pressurizes a toner seal 24 (see FIG. 3).

Due to this arrangement, if there is a fluctuation in the distance between the opposing surfaces of the toner container 16 and the development frame 17, the resistance when a displacement is generated can be minimized due to the sack-like bellows configuration of the sheet member 21. Further, by mounting the sheet member 21 between the plate-like member 23 and the development frame 17, it is possible to effect mounting such that the plate-like member 23 covers the toner seal, whereby it is possible to mount a toner sealing member 25 in the gap where the toner seal 24 passes, thereby preventing toner leakage.

Further, when effecting sealing of the plate-like member 23 and the development frame 17 in the same plane, the configuration of the requisite welding bearer can be simplified, as compared with the case in which direct attachment to the toner container 16 is effected.

Further, the presence of the plate-like member 23 makes a unitization with the development frame 17 possible, thereby facilitating the mounting to the toner container 16.

Attachment and Detachment of Process Cartridge

Next, the attachment and detachment of the process cartridge 15 will be described.

Figure 8:
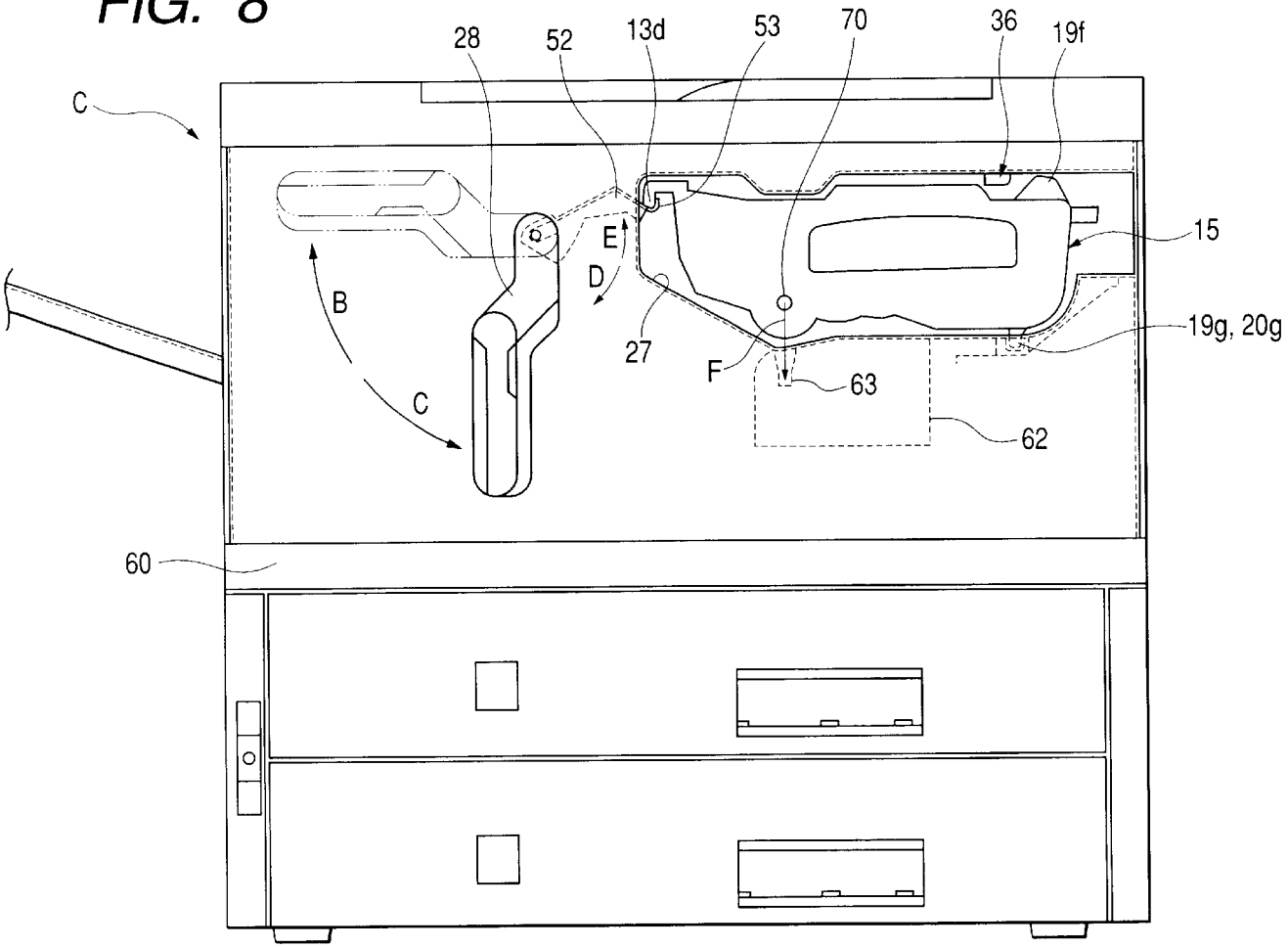
FIG. 8 is a front view of an image forming apparatus in accordance with an embodiment of the present invention.

FIG. 8 shows the apparatus main body C with the cartridge 15 inserted therein.

When a front cover 60 of the apparatus main body C is opened, an opening 27, which is the inlet of the cartridge mounting portion, is visible. Here, the lower edge of the cover 60 is mounted to the apparatus main body C with a hinge having a horizontal axis, enabling the front side of the apparatus main body C to be opened and closed.

Figure 9:
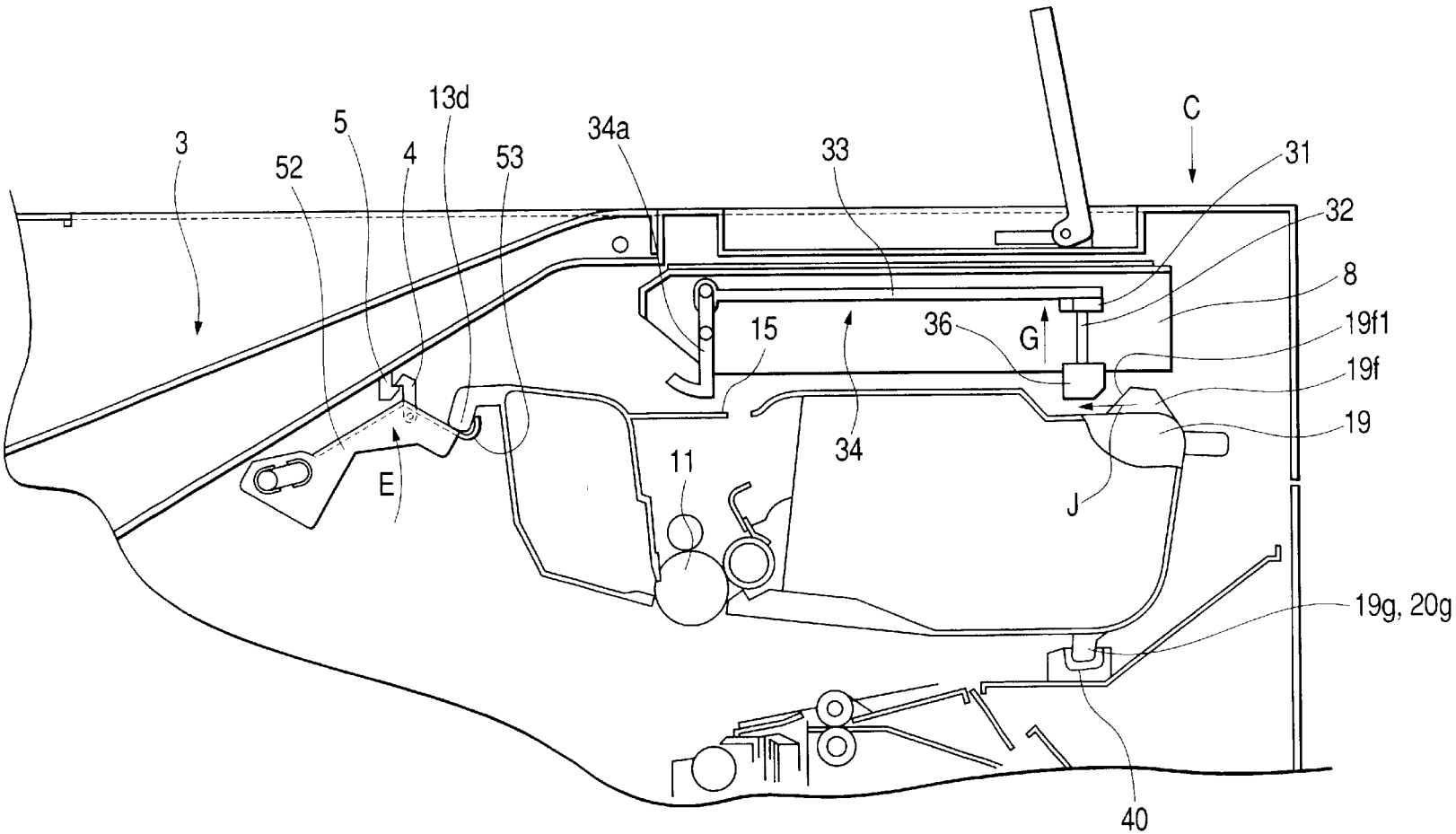
FIG. 9 is a front view of a link mechanism in accordance with the embodiment of the present invention.

As shown in FIG. 9, a lever 52 is provided with a hook 4, which is engaged with a hook 5 provided on the apparatus main body C to support the lever 52.

As shown in FIG. 9, when inserting the cartridge 15 into the apparatus main body C, a protrusion 13*d* provided on the cartridge 15, and protrusions 19*g* and 20*g* respectively provided on side covers 19 and 20 are caused to slide along a guide groove 53 at the forward end of the lever 52 provided in the apparatus main body C, and a guide groove 40 provided in the apparatus main body C to thereby effect the insertion. Here, the protrusions 19*g* and 20*g* constitute supported portions in which the cartridge 15 is supported and a rotation fulcrum portion.

The guide groove 40 has a length that is approximately the same as the length in the longitudinal direction of the cartridge 15 (the direction parallel to the axis of the photosensitive drum 11).

After the insertion, the cartridge 15 is substantially in the horizontal position.

Next, after the insertion of the cartridge, an operating handle 28 (See FIG. 8) provided in the apparatus main body C is rotated in the direction B in FIG. 8, whereby the hook 4 is detached from the hook 5 by an interlock mechanism (not shown) operationally connected with the rotation of the handle 28, and the lever 52 is rotated, the guide groove 53 being lowered in the direction D in FIG. 8. Then, a positioning member 70 coaxial with the photosensitive drum 11 is lowered substantially in the direction of the arrow F to be engaged with a groove 63 of a plate-like member 62, which is parallel to the plane of FIG. 8, of the apparatus main body C, to thereby effect positioning of the cartridge. Here, the guide groove 53 is provided in the forward end portion of a lever 52. The lever 52 is provided such that its base portion is longitudinally movable and rotatable, and is engaged with the operating handle 28 through the intermediation of a lever (not shown).

To detach the cartridge 15, the handle 28 is rotated in the direction of the arrow C, and the lever 52 is rotated in the direction of the arrow E.

Laser Beam Shielding Mechanism

Figure 10:
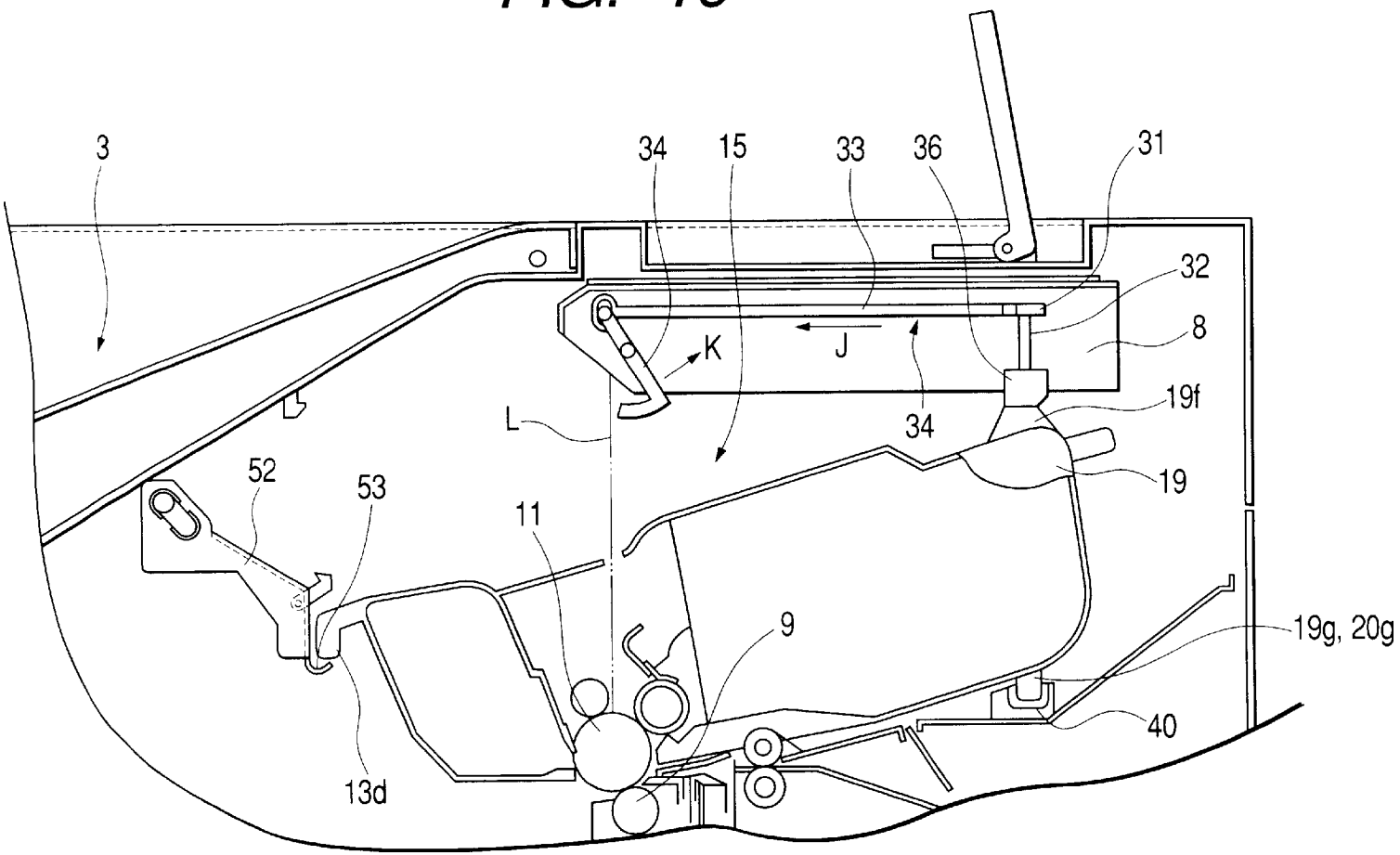
FIG. 10 is a front view of a link mechanism in accordance with the embodiment of the present invention.
Figure 11:
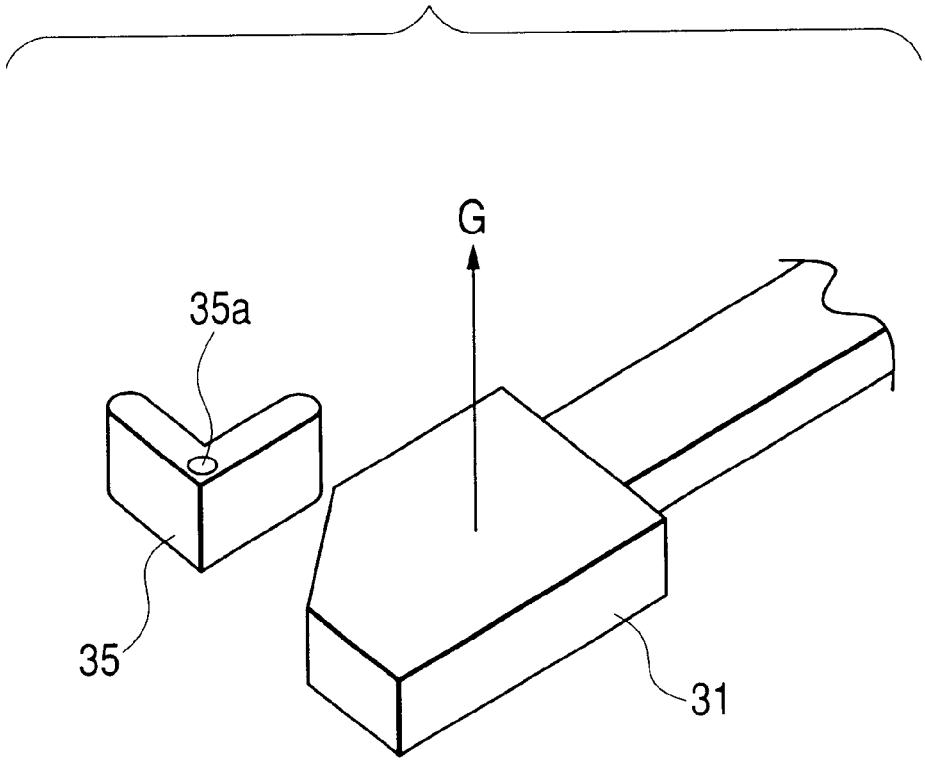
FIG. 11 is a perspective view of a link mechanism in accordance with the embodiment of the present invention.
Figure 12:
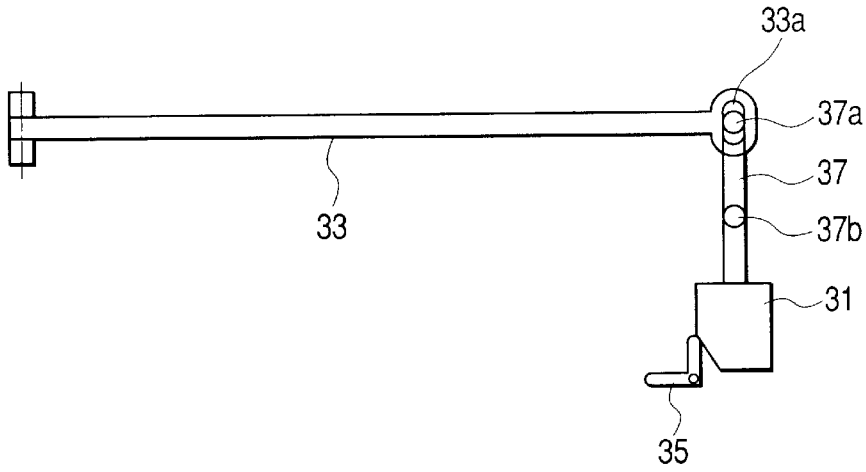
FIG. 12 is a plan view of a link mechanism in accordance with the embodiment of the present invention.
Figure 13:
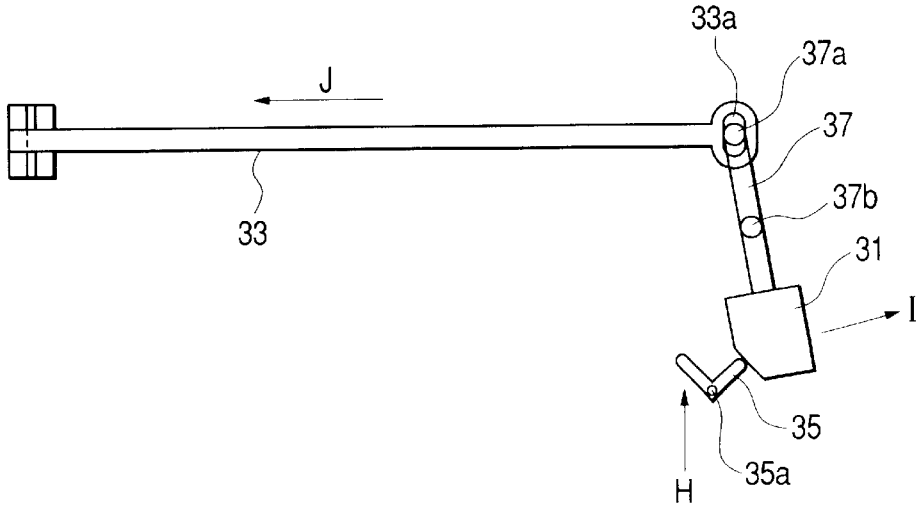
FIG. 13 is a plan view of the link mechanism in accordance with the embodiment of the present invention.

Next, the manner in which a laser beam shielding mechanism 34 operates when placing the cartridge 15 in position will be described with reference to FIGS. 1 and 9 through 13 (FIGS. 12 and 13 are views illustrating a portion around a link 33 shown in FIGS. 9 and 10 as seen from above the image forming apparatus main body).

As stated above, when the cartridge 15 is inserted into the apparatus main body C, a protrusion 19*f* constituting an abutting portion provided in the upper portion of the cartridge is in contact with nothing (see FIG. 9). The protrusion 19*f* has an inclined surface 19*f*1 forwardly sloping down from the apex in the direction of the arrow J.

In the next operation, i.e., the cartridge rotating operation (the rotation center is the protrusions 19*g*, 20*g* constituting the rotation fulcrum portion), the protrusion 19*f* substantially moves in the direction of the arrow J. A cam member 36 is fixed to the lower end of a bar 32 supported by the apparatus main body C so as to be vertically movable. Then, the protrusion 19*f* is positioned so as to abut the cam member 36 to push up the cam member 36. Thus, the cam member 36 and the bar 32 move upwardly in the direction of the arrow G, whereby a cam member 31 is also pushed by the bar 32 to move upwards until the cam member 31 becomes the same height as a bell crank member 35 as shown in FIG. 11. In the condition in which the cartridge 15 is not mounted to the cartridge mounting portion, the cam member 36 must be in the lowered position. Thus, it is constantly downwardly urged by a biasing means (not shown).

As shown in FIGS. 12 and 13, the cam member 31 is mounted to one end of a lever 37, which is vertically movable by means of a vertical shaft 37*b* and rotatable around the vertical shaft 37*b*. The other end of the lever 37 is connected by a pin 37*a* to an elongated hole 33*a* provided at one end of a link 33. The longitudinal direction of the elongated hole 33*a* crosses the longitudinal direction of the link 33. The link 33 is supported by the apparatus main body C so as to be movable to the right and left.

Next, the front cover 60 provided on the front side of the apparatus main body C (the side where the opening 27 exists) is closed, and thus, as shown in FIG. 13, the bell crank member 35 is pushed in the direction of the arrow H of FIG. 13 to rotate clockwise around an axle 35*a*, pushing the cam member 31 in the direction of the arrow I of FIG. 13 and rotating the lever 37 counterclockwise around a vertical shaft 37*b*, while the pin 37*a* moves to the left to cause the link 33 to move in the direction J, that is, to the left in FIG. 13.

Figure 14:
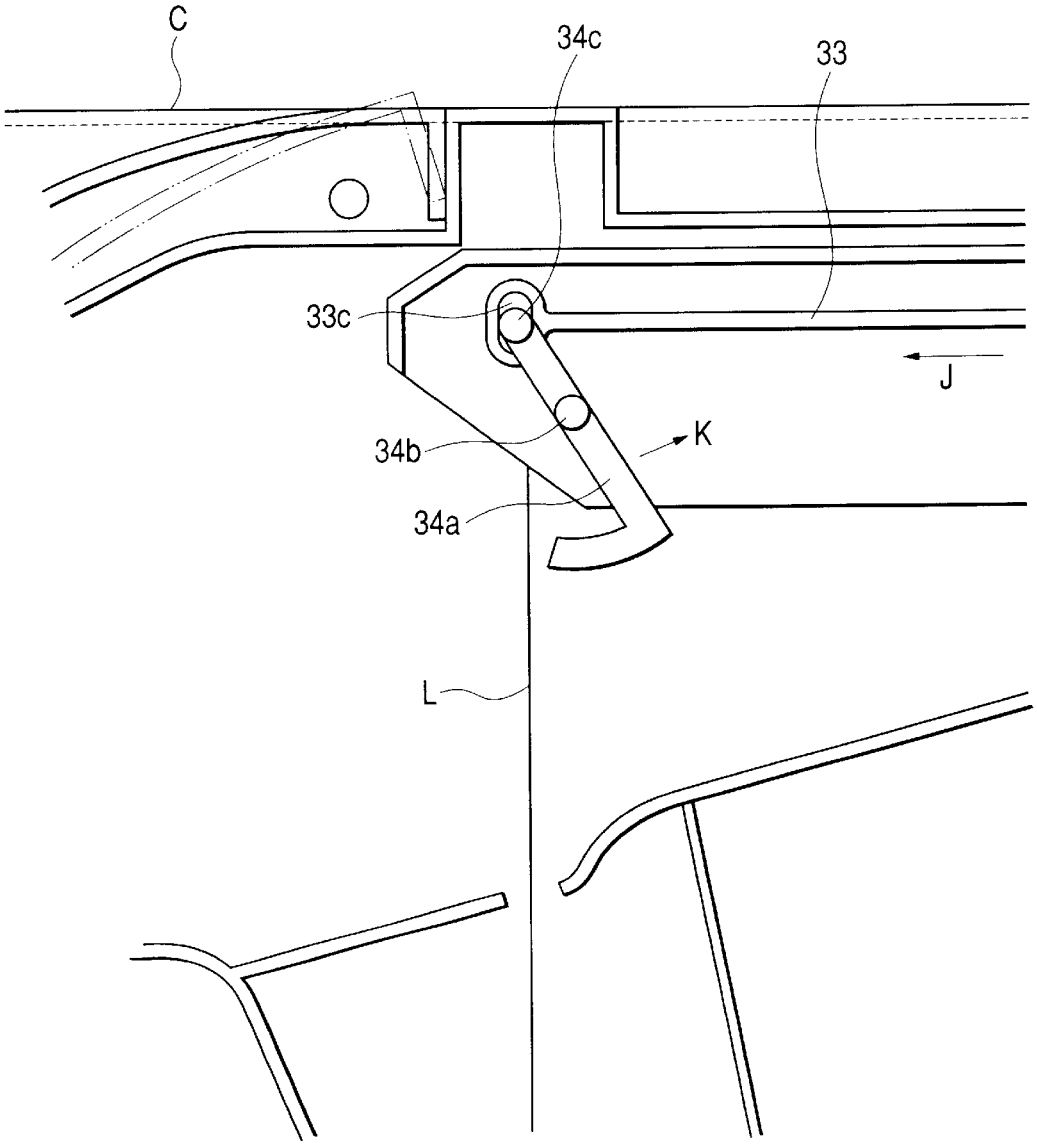
FIG. 14 is an enlarged view of a portion of FIG. 1, showing a laser shutter.
Figure 15:
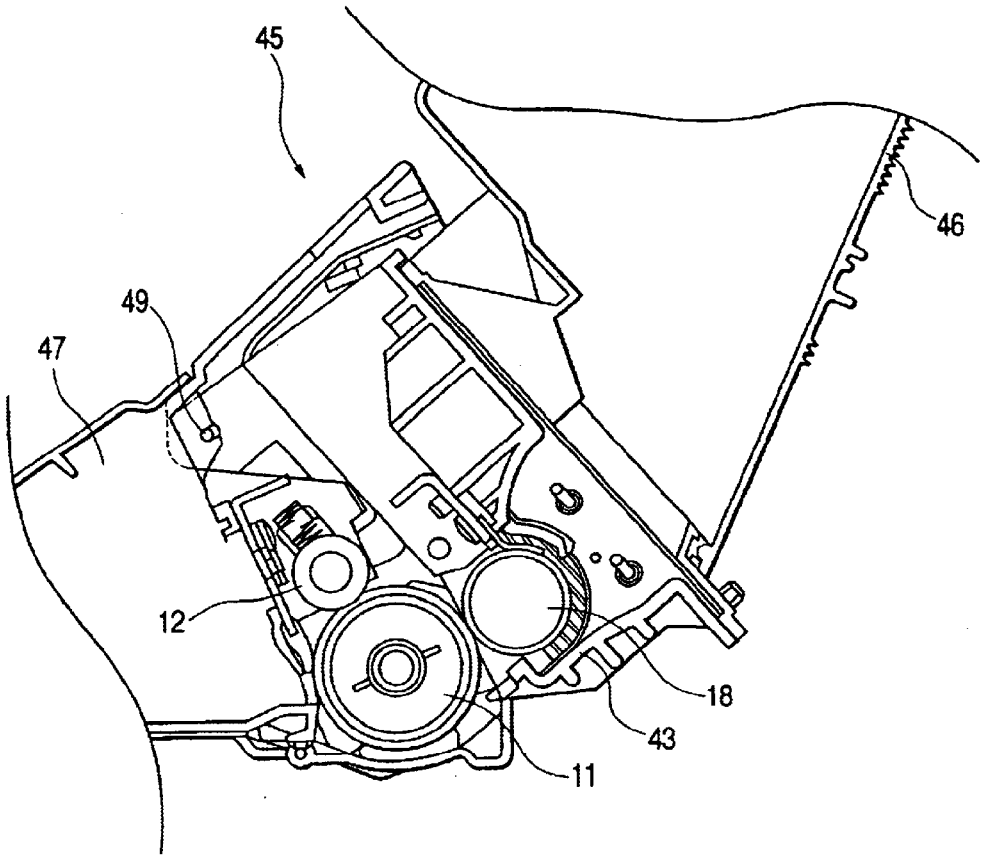
FIG. 15 PRIOR ART
FIG. 15 is a schematic principal sectional view of a process cartridge of a conventional form.

As shown in FIG. 1, the link 33 moves in the direction of the arrow J in FIG. 1, whereby, as shown in FIG. 14, a laser beam shielding member 34*a* retracts in the direction of the arrow K to secure the optical path L for the laser. The laser beam shielding member 34*a* is rotatably mounted on the apparatus main body C by means of a pin 34*b*, and one end thereof is connected to an elongated hole 33*c* at the end of the link 33 by a pin 34*c*. The longitudinal direction of the elongated hole 33*c* crosses the longitudinal direction of the link 33.

That is, by closing the front cover of the apparatus main body after lowering the cartridge 15 and completing positioning, the laser optical path is secured.

In the present embodiment, the longitudinal length of the laser beam shielding member 34*a* is large enough to cover the laser beam application range (the longitudinal direction not shown).

In the present embodiment, by arranging the rotation center at the bottom of the side cover, it is possible to form the rotation center of the cartridge and the protrusion 19*f* serving as the abutting portion against the laser beam shielding device integrally with the side cover, so that an accurate positional relationship between the rotation center and the abutting portion can be achieved. Further, by providing the protrusion 19*f* substantially above the rotation center, the protrusion 19*f* can be disposed near the rotation center to operate the laser beam shielding device with high accuracy.

In the construction in which the laser exposure device 8 is arranged above the cartridge, the laser beam shielding device is also arranged above the cartridge in the vicinity of the laser exposure device, whereby the length of the link structure can be shortened, and an improvement in reliability can be achieved.

Further, due to the provision of the protrusions 19*g* and 20*g* constituting the rotation center at the bottom of the side cover, the side cover is damaged if the cartridge is inadvertently dropped, and when it is compared with the case in which they are provided at the bottom of the developer container and in which the developer container is damaged, there is less danger of developer flowing out.

Further, due to the provision of the protrusions 19*g* and 20*g* constituting the rotation center at the bottom and near the rear end of the developer container, it is possible to decrease the influence of the fluctuation in the center of gravity of the process cartridge (due to leaning of the developer to one side) on the rotating operation.

As is apparent from the above description, in the case in which the process cartridge is swung inside the apparatus main body so that the process cartridge is mounted to and dismounted from the apparatus main body, the laser beam shielding mechanism is operated by the abutting portion provided on the process cartridge, whereby the shielding mechanism is opened by two steps of operation, i.e., the rotation (lowering) of the process cartridge and the closing of the front cover, so that it is possible to achieve a double protection against erroneous laser beam application. Further, due to its simple configuration, it is possible to restrain an increase in the cost of the process cartridge.

Further, since the abutting portion is sufficiently spaced apart from the rotation fulcrum, high accuracy operation can be achieved.

Furthermore, since the abutting portion is pressurized by the image forming apparatus main body, it is also possible to stabilize the attitude of the process cartridge.

As described above, in accordance with the embodiments, the present invention relates to a process cartridge detachably mountable to an image forming apparatus main body, the process cartridge comprising:

an electrophotographic photosensitive drum;

process means acting on the electrophotographic photosensitive drum;

a rotation fulcrum portion which constitutes a supported portion in which the process cartridge is supported by the image forming apparatus main body when the process cartridge is to be mounted to the image forming apparatus main body and which is parallel to the electrophotographic photosensitive drum; and an abutting portion which is provided in a position spaced apart from the rotation fulcrum portion and which moves when the process cartridge is rotated around the rotation fulcrum portion when the process cartridge is to be mounted to and detached from the image forming apparatus main body to thereby act on a laser beam shielding mechanism provided in the image forming apparatus main body so as to open and close the laser beam shielding mechanism.

The abutting portion may be provided on a support member fixed to a developer container and a drum frame so as to integrally support the developer container and the drum frame supporting the electrophotographic photosensitive drum.

The rotation fulcrum portion may be provided on a support member fixed to a developer container and a drum frame so as to integrally support the developer container and the drum frame supporting the electrophotographic photosensitive drum.

The rotation fulcrum portion may be provided substantially at the bottom of the process cartridge.

Further, the present invention relates to an electrophotographic image forming apparatus to which a process cartridge is detachably mountable for forming an image on a recording medium, the electrophotographic image forming apparatus comprising:

a) mounting means for detachably mounting the process cartridge, the process cartridge including:

an electrophotographic photosensitive drum;

process means acting on the electrophotographic photosensitive drum;

a rotation fulcrum portion which constitutes a supported portion in which the process cartridge is supported by the image forming apparatus main body when the process cartridge is to be mounted to the image forming apparatus main body and which is parallel to the electrophotographic photosensitive drum;

an abutting portion which is provided in a position spaced apart from the rotation fulcrum portion and which moves when the process cartridge is rotated around the rotation fulcrum portion when the process cartridge is to be mounted to and detached from the image forming apparatus main body to thereby act on a laser beam shielding mechanism provided in the image forming apparatus main body so as to open and close the laser beam shielding mechanism, wherein the mounting means has a guide member for guiding the rotation fulcrum portion along a rotation center axial direction and cartridge swinging means for supporting the process cartridge at a position spaced apart from the guide member to swing the process cartridge around the guide member;

b) the laser beam shielding mechanism in which a laser shutter is opened and closed by movement of the abutting portion by process cartridge mounting and detaching operations; and c) conveying means for conveying the recording medium.

As described above, in accordance with the present invention, no laser beam is allowed to leak to the exterior.

While the invention has been described with reference to the structure disclosed herein, it is not confined to the details set forth and this application is intended to cover such modifications or changes as may come within the purposes of the improvements or the scope of the following claims.

What is claimed is:

1. A process cartridge detachably mountable to an image forming apparatus main body, said process cartridge comprising:

an electrophotographic photosensitive drum;

process means acting on said electrophotographic photosensitive drum;

a rotation fulcrum portion which constitutes a supported portion of said process cartridge, said supported portion being supported by the image forming apparatus main body when said process cartridge is mounted to the image forming apparatus main body and which is parallel to said electrophotographic photosensitive drum; and an abutting portion which is provided in a position spaced apart from said rotation fulcrum portion and which moves when said process cartridge is rotated around said rotation fulcrum portion when said process cartridge is mounted to the image forming apparatus main body to thereby enable a laser beam shielding mechanism provided in the image forming apparatus main body.

2. A process cartridge according to claim 1, wherein said abutting portion is provided on a support member fixed to a developer container and a drum frame supporting said electrophotographic photosensitive drum so as to integrally support the developer container and the drum frame.

3. A process cartridge according to claim 1, wherein said rotation fulcrum portion is provided on a support member fixed to a developer container and a drum frame supporting said electrophotographic photosensitive drum so as to integrally support the developer container and the drum frame.

4. A process cartridge according to any one of claims 1–3, wherein said rotation fulcrum portion is provided substantially at the bottom of said process cartridge.

5. A process cartridge according to claim 1, wherein said process cartridge is rotated around said rotation fulcrum portion when said process cartridge is detached from said image forming apparatus main body, and said abutting portion moves to disable the laser beam shielding mechanism.

6. An electrophotographic image forming apparatus to which a process cartridge is detachably mountable for forming an image on a recording medium, said electrophotographic image forming apparatus comprising:

a) mounting means for detachably mounting the process cartridge, the process cartridge including:

an electrophotographic photosensitive drum;

process means acting on the electrophotographic photosensitive drum;

a rotation fulcrum portion which constitutes a supported portion of the process cartridge, the supported portion being supported by an image forming apparatus main body when the process cartridge is mounted to said image forming apparatus main body and which is parallel to the electrophotographic photosensitive drum; and an abutting portion which is provided in a position spaced apart from the rotation fulcrum portion and which moves when the process cartridge is rotated around the rotation fulcrum portion when the process cartridge is mounted to said image forming apparatus main body to thereby enable a laser beam shielding mechanism provided in said image forming apparatus main body, wherein said mounting means has a guide member configured and positioned to guide the rotation fulcrum portion along a rotation center axial direction and cartridge swinging means for supporting the process cartridge at a position spaced apart from said guide member to swing the process cartridge around said guide member;

b) said laser beam shielding mechanism in which a laser shutter is opened and closed by movement of the abutting portion by process cartridge mounting and detaching operations; and c) conveying means for conveying the recording medium.

7. An electrophotographic image forming apparatus according to claim 6, wherein when the process cartridge is rotated around the rotation fulcrum portion when the process cartridge is detached from said image forming apparatus main body, and the abutting portion moves to disable the laser beam shielding mechanism.

8. A process cartridge detachably mountable to an electrophotographic image forming apparatus main body, the electrophotographic image forming apparatus main body including an openable and closable member, laser beam emitting means for emitting a laser beam, a shutter movable between a shielding position in which the shutter shields an optical path through which the laser beam emitted from the laser beam emitting means passes and an open position in which the shutter is retracted from the shielding position to allow the laser beam to pass, a first member configured and positioned to move the shutter, and a second member, said process cartridge comprising:

an electrophotographic photosensitive drum;

process means acting on said electrophotographic photosensitive drum; and an abutting portion configured and positioned to move the first member to an engagement position, in which the first member is engageable with the second member, in accordance with an operation of mounting said process cartridge in a positioning location in the image forming apparatus main body, wherein said process cartridge is insertable in the image forming apparatus main body, and once inserted descends about a rotation fulcrum portion to thereby be mounted in the positioning location, wherein mounting of said process cartridge in the positioning location moves the first member to the engagement position, and wherein the second member moves the first member positioned in the engagement position to move the shutter to the open position in association with closing of the openable and closable member after said process cartridge is mounted in the positioning location.

9. A process cartridge according to claim 8, wherein the rotation fulcrum portion is disposed parallel to said electrophotographic photosensitive drum and in a position assuming substantially the bottom surface of said process cartridge when said process cartridge is mounted in the positioning location.

10. A process cartridge according to claim 8 or 9, wherein said abutting portion is disposed in a position assuming substantially the upper surface of said process cartridge when said process cartridge is mounted in the positioning location.

11. A process cartridge according to claim 10, wherein said abutting portion is provided on a support member fixed to a developer container and a drum frame supporting said electrophotographic photosensitive drum so as to integrally support the developer container and the drum frame.

12. A process cartridge according to claim 8 or 9, wherein the rotation fulcrum portion is provided on a support member fixed to a developer container and a drum frame supporting said electrophotographic photosensitive drum so as to integrally support the developer container and the drum frame.

13. An electrophotographic image forming apparatus to which a process cartridge is detachably mountable for forming an image on a recording medium, said electrophotographic image forming apparatus comprising:

(i) an openable and closable member;

(ii) laser beam emitting means for emitting a laser beam;

(iii) a shutter movable between a shielding position in which said shutter shields an optical path through which the laser beam emitted from said laser beam emitting means passes and an open position in which said shutter is retracted from said shielding position to allow the laser beam to pass;

(iv) a first member configured and positioned to move said shutter;

(v) a second member;

(vi) a mounting portion to which the process cartridge is detachably mountable, the process cartridge including:

an electrophotographic photosensitive drum;

process means acting on the electrophotographic photosensitive drum; and an abutting portion configured and positioned to move said first member to an engagement position, in which said first member is engageable with said second member, in accordance with an operation of mounting the process cartridge in a positioning location in a main body of said image forming apparatus, wherein the process cartridge is insertable in the main body of said image forming apparatus, and once inserted, the process cartridge descends about a rotation fulcrum portion to thereby be mounted in the positioning location; and (vii) conveying means for conveying the recording medium, wherein mounting of the process cartridge in the positioning location moves said first member to the engagement position, and wherein said second member moves said first member positioned in the engagement position to move said shutter to the open position in association with closing of said openable and closable member.

14. An electrophotographic image forming apparatus according to claim 13, wherein the rotation fulcrum portion is disposed parallel to the electrophotographic photosensitive drum and in a position assuming substantially the bottom surface of the process cartridge when the process cartridge is mounted in the positioning location.

15. An electrophotographic image forming apparatus according to claim 13 or 14, wherein the abutting portion is disposed in a position assuming substantially the upper surface of the process cartridge when the process cartridge is mounted in the positioning location.

16. An electrophotographic image forming apparatus according to claim 15, wherein the abutting portion is provided on a support member fixed to a developer container and a drum frame supporting the electrophotographic photosensitive drum so as to integrally support the developer container and the drum frame.

17. An electrophotographic image forming apparatus according to claim 13 or 14, wherein the rotation fulcrum portion is provided on a support member fixed to a developer container and a drum frame supporting the electrophotographic photosensitive drum so as to integrally support the developer container and the drum frame.

* * * * *